US005806088A

United States Patent [19]

Zide et al.

[11] Patent Number: 5,806,088

[45] Date of Patent: Sep. 15, 1998

[54] FACE GUARD

[75] Inventors: Robert M. Zide, Williamstown; James L. Rector, Vienna, both of W. Va.

[73] Assignee: Zides Sport Shop, Marietta, Ohio

[21] Appl. No.: 861,115

[22] Filed: May 21, 1997

[51] Int. Cl.[6] ..... A42B 3/20

[52] U.S. Cl. ..... 2/9; 2/424

[58] Field of Search ..... 2/410, 411, 412, 2/422, 424, 425, 9

[56] References Cited

U.S. PATENT DOCUMENTS

| | | | |
|---|---|---|---|
| 25,176 | 5/1859 | Novack . | |
| 2,105,607 | 1/1938 | McMillan . | |
| 2,785,406 | 3/1957 | Rappleyea et al. . | |
| 2,929,070 | 3/1960 | Novak . | |
| 2,929,102 | 3/1960 | Rappleyea et al. . | |
| 3,139,624 | 7/1964 | Humphrey . | |
| 3,263,236 | 8/1966 | Humphrey . | |
| 3,341,201 | 9/1967 | Ryan . | |
| 3,854,146 | 12/1974 | Dunning | 2/9 |
| 4,086,664 | 5/1978 | Humphrey et al. . | |
| 4,220,301 | 9/1980 | Jacobs et al. . | |
| 4,342,122 | 8/1982 | Abraham et al. . | |
| 4,370,759 | 2/1983 | Zide | 2/424 |
| 4,390,995 | 7/1983 | Walck | 2/9 |
| 4,633,531 | 1/1987 | Nimmons . | |
| 4,689,835 | 9/1987 | Draft et al. . | |
| 5,142,700 | 8/1992 | Reed . | |
| 5,267,353 | 12/1993 | Milligan . | |

*Primary Examiner*—Michael A. Neas

*Attorney, Agent, or Firm*—Birch, Stewart, Kolasch & Birch, LLP

[57] ABSTRACT

A face guard 10 employs a plurality of tubular curved members 12. The geometric configuration of the tubular members 12 is suitable for a football line backer's helmet face guard. The tubular curved members 12 are slightly indented where they cross another tubular member 12. Each tubular curved member 12 is slightly tapered at its ends. The tapered ends 14 reduce the need for grinding and facilitates easy coating of the tubular curved members with a synthetic resin 18. The tapered ends 14 are welded to other tapered ends 14 of other tubular curved members 12. Beneath the synthetic resin coating 18 is an inner metal curved tube 22. The curved metal tube 22 has a wall thickness T1 and an outer diameter D1. The outer diameter D1 and inner wall thickness T1 are a function of at least three ratios. The ratios provide a tubular member design that protects the user from frontal and side impact forces and reduces fatigue of the user while providing a relatively unobstructed field of vision for the user.

4 Claims, 1 Drawing Sheet

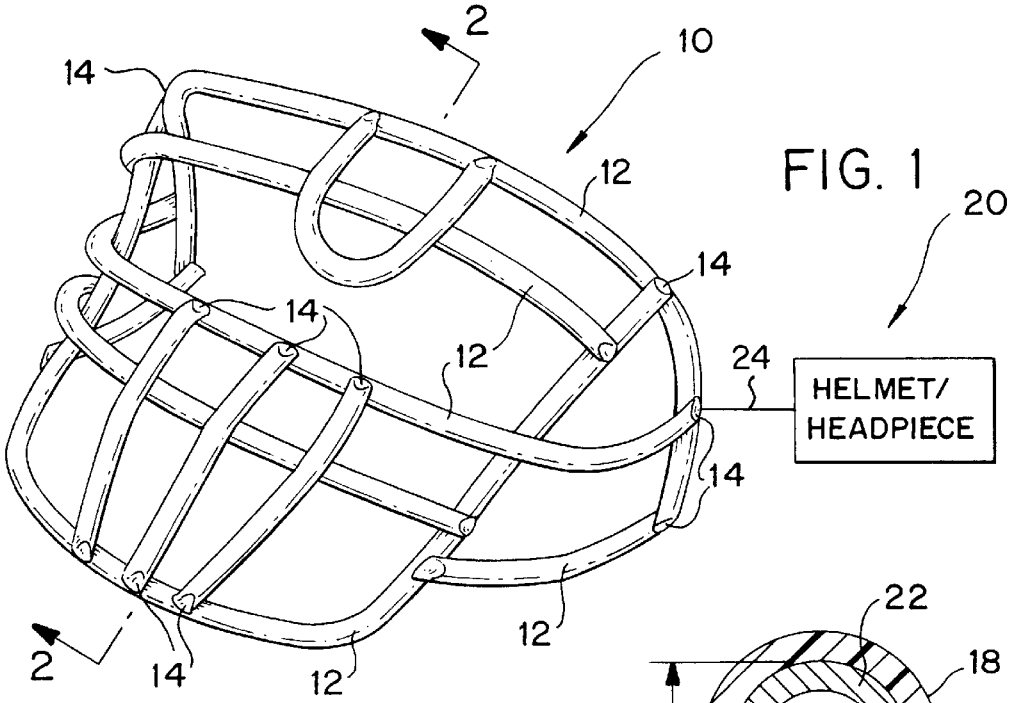
FIG. 1
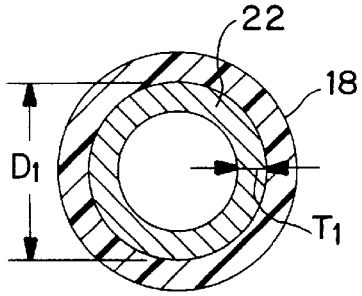
FIG. 3
FIG. 2
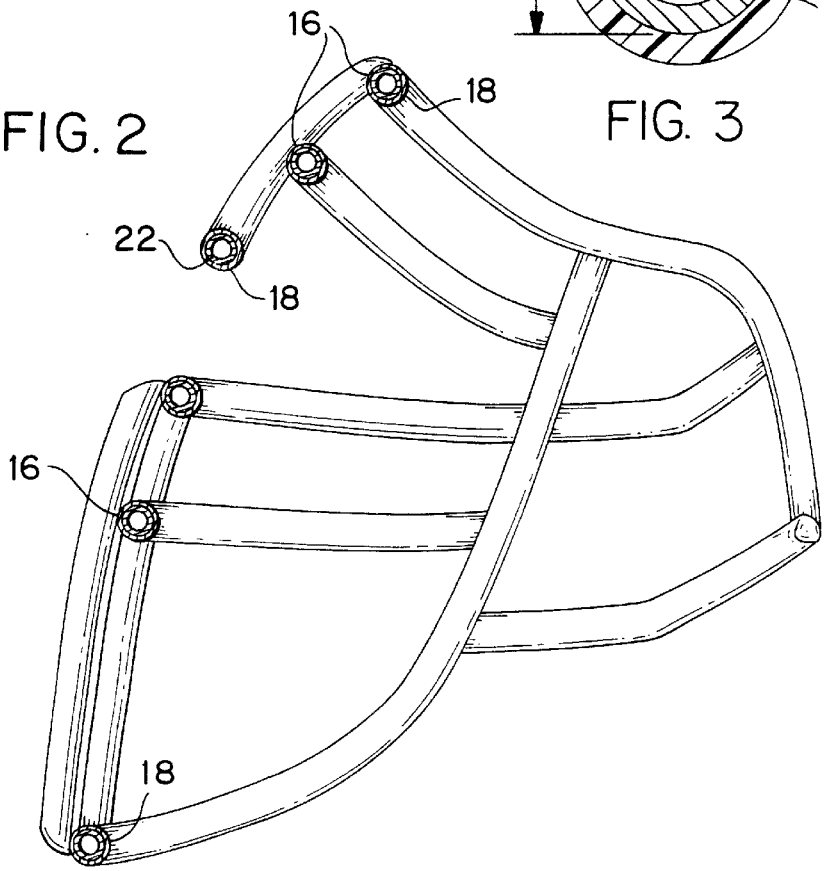

FACE GUARD

BACKGROUND OF THE INVENTION

1. Field of the Invention

The present invention relates generally to a face guard for an athletic helmet, such as a face guard for a football helmet.

2. Description of the Background

Conventional metal face guards are typically made with solid metal rods. These conventional face guards have the disadvantages of relatively heavy weight, and distortion by bending after repeated, heavy frontal impacts which adversely affect the shape and fit of the helmets. Other face guards made from plastic are also known in the art.

Although plastic face guards have an advantage of light weight, they have the disadvantage of thick components to compensate for the relative weakness of the plastic material. The lack of stiffness in plastic face guards allows the structure to spread under frontal impacts. The plastic face guards further have the disadvantage of significantly obstructing the field of vision of the user.

The solid metal face guards have the disadvantage of causing muscle fatigue in the neck and head of the user due to the significant weight of the metal face guard. The weight of the solid metal face guards also contributes to the sluggish response of the user who attempts to move the face guard rapidly during an activity. The solid metal face guards also are detrimental to people who are hit with the solid metal face guards. Due to the larger mass of the solid metal face guard, the impact forces of the solid metal face guard are significantly large during a collision.

Accordingly, a need in the art exists for a light weight face guard which can absorb frontal impact forces without permanent deformation. Furthermore, a need exists in the art to provide a face guard which does not limit the field of vision of the user.

SUMMARY OF THE INVENTION

It is a primary object of the present invention to provide a face guard which is lighter, stronger, and stiffer and reduces head and neck fatigue of the user.

It is additionally a further object of the present invention to promote quick response of the face guard user by permitting the user to move his/her head and body more rapidly.

It is a further object to provide a face guard which reduces the force of impact on a person or object being hit by a user with the face guard.

Another object of the present invention is to provide a stronger face guard structure that does not significantly reduce the field of vision of a user.

It is a further object of the present invention to provide a face guard which can have facial protection configurations with multiple geometries.

These and other objects of the present invention are fulfilled by providing a face guard comprising at least one tubular curved member having a predetermined outer diameter and a predetermined wall thickness, the outer diameter and wall thickness being a function of at least three ratios, the tubular member being made of at least one of a metal and metal mixture; a coating for covering the at least one tubular member; a first ratio of the at least three ratios being a relative strength to weight ratio, wherein strength of the tubular member being at least equal to a solid rod made of a same material of the tubular member and a rod having an outer diameter slightly less than the tubular curved member, while weight of the tubular being substantially less than the solid rod, whereby frontal and side impact forces are absorbed by the tubular member without deformation; a second ratio of the at least three ratios being a relative vision obstruction to strength ratio, wherein the face guard is adapted to be placed in a field of vision of a user, the field of vision having the at least one tubular member is substantially similar to a field of vision having a solid rod with a same shape as the tubular member, while the tubular member has strength to absorb the frontal and side impact forces, whereby the vision of the user is substantially unobstructed; and a third ratio of the at least three ratios being a relative vision obstruction to weight ratio, wherein the face guard is adapted to be placed in a field of vision of a user, a field of vision having the at least one tubular member is substantially similar to a field of vision having a solid rod with a same shape of the tubular member, while weight of the tubular member being substantially less than the solid rod, whereby the vision of the user is substantially unobstructed; and whereby the at least one tubular member protects the user from the frontal and side impact forces and reduces fatigue of the user.

In addition, these and other objects of the present invention are also accomplished by a method of making a face guard comprising the steps of providing at least one tubular curve member having a predetermined outer diameter and a predetermined wall thickness; calculating a first ratio of at least three ratios which relates the relative strength to weight of the tubular member, wherein strength of the tubular member being at least equal to a solid rod made of the same material of the tubular member and the rod having an outer diameter slightly less than the tubular member, while weight of the tubular member being substantially less than the solid rod, whereby frontal and side impact forces are absorbed by the tubular member without deformation; calculating a second ratio of at least three ratios which relates a field of vision having the at least one tubular member to strength of the at least one tubular member, wherein the face guard is adapted to be placed in a field of vision of a user, a field of vision having the at least one tubular member substantially similar to a field of vision having a solid rod with a same shape of the tubular member, while the tubular member has strength to absorb the frontal and side impact forces, whereby the vision of the user is substantially unobstructed; calculating a third ratio of at least three ratios which relates a field of vision having the at least one tubular member to weight of the at least one tubular member, wherein the face guard is adapted to be placed in a field of vision of a user, the field of vision having the at least one tubular member substantially similar to a field of vision having a solid rod with a same shape of the tubular member, while weight of the tubular member being substantially less than the solid rod, whereby vision of the user is substantially unobstructed; forming the outer diameter and wall thickness of the at least one tubular curved member utilizing the at least three calculated ratios, the tubular member being made of at least one of a metal and metal mixture, and coating the at least one tubular member, wherein the at least one tubular member protects the user from frontal and side impact forces and reduces fatigue of the user.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 shows a predominantly front view of the face guard;

FIG. 2 shows a side/cross-sectional view of the face guard of the present invention; and FIG. 3 shows a cross-sectional view of a tubular curved member.

DETAILED DESCRIPTION OF THE PREFERRED EMBODIMENTS

Referring in detail to the drawings and with particular reference to FIG. 1, the face guard 10 of the present invention is shown connected to a conventional helmet 20. The face guard can be used with many types of helmets/headpieces for different sports, such as football, baseball, softball, lacrosse, field hockey, ice hockey, racquetball, etc. The face guard can be used with helmets/headpieces that are used for activities other than athletics such as combat situations, combat training or self-defense training. It is contemplated that the face guard of the present invention will be used with a football helmet where the face guard is mounted to the sides of the football helmet by conventional means 24 for connecting. Such means 24 for connecting can include a known shock absorbing connector for football helmets, for example.

As seen in FIG. 1, the face guard 10 employs a plurality of tubular curved members 12. The tubular curved members 12 can have many different geometries to provide several different facial protection configurations adapted for the intended environment of the helmet. The geometric configuration of the tubular members 12 shown in FIG. 1 is suitable for a football line backer's helmet face guard. However, as noted above, the geometry of the tubular curved members 12 can be changed to suit the intended environment. For example, a single tubular curve member 12 could be employed to provide a face guard for a football kicker/punter.

The tubular curved members 12 are slightly indented where they cross another tubular member 12 in embodiments with multiple tubular curved members 12. The indentations are labeled as reference numeral 16. Each tubular curved member 12 is slightly tapered at its ends. The tapered ends 14 reduce the need for grinding and facilitates easy coating of the tubular curved members with a synthetic resin 18. The synthetic resin is preferably plastic but can be made from other materials such as rubber, and other appropriate commercial plastics. Durable vinyl is used as the plastic coating for the tubular members of the preferred embodiment. The synthetic resin coating 18 permits distinctive coloring of the face guard in addition to protection against sharp edges present on the face guard due to manufacturing or damages from frontal impacts.

The tapered ends 14 are welded to other tapered ends 14 of other tubular curved members 12. The tapered ends 14 are welded by conventional resistance welding, sometimes called "spot welding". However, other types of welding may be employed such as by metal arc welding, sometimes called "stick welding" wherein filler metal is hand melted onto the connection point and into the tapered end 14 of the tubular curved member 12. Since resisting welding lends itself to automation, speed, and economy, the preferred embodiment of this invention is welded by this type of welding.

Beneath the synthetic resin coating 18 is an inner metal curved tube 22. The curved metal tube 22 is not limited to curved geometries and therefore it could be formed as a straight tube member for specific applications of the face guard. The curved metal tube 22 is preferably made out of steel. However, other metals and/or metal alloys (metal mixtures) may be employed which comprise aluminum, carbon, cobalt, chromium, iron, nickel, tin, titanium, and zinc or the like.

The curved metal tube 22 has a wall thickness T1 and an outer diameter D1. The outer diameter D1 and inner wall thickness T1 are a function of at least three ratios.

The first ratio of the at least three ratios is a relative strength to weight ratio, where the strength of the curved metal tube 22 is at least equal to a solid metal rod made of a same material and shape as the curved metal tube and the rod has an outer diameter slightly less than the curved solid metal tube 22, while the weight of the curved metal tube 22 is substantially less than the solid metal rod. The first ratio provides a design of the curved metal tube where frontal and side impact forces are absorbed by the curved metal tube 22 without deformation. Absorption of forces in the curved metal tube design would be at least the same as that found in the noted solid metal rod design.

A second ratio of the at least three ratios is a relative vision obstruction to strength ratio. This ratio is a function of the curved metal tube 22 being placed in a field of vision of a user where the field of vision having the curved metal tube 22 is substantially similar to a field of vision having a solid rod with the same shape of the curved metal tube 22, while the curved metal tube 22 has enough strength to absorb frontal and side impact forces. In this design, the vision of the user is therefore substantially unobstructed.

The third ratio of the at least three ratios is a relative vision obstruction to weight ratio. The third ratio is a function of the face guard being adapted to be placed in a field of vision of a user, such as on a helmet. The curved metal tube 22 design is substantially similar to a field of vision having a curved solid rod design with the same shape of the curved metal tube while weight of the curved metal tube 22 is substantially less than the curved solid metal rod. The third ratio also results in the vision of the user being substantially unobstructed.

As a result of these ratios/design variables, the curved metal tube 22 has an outer diameter D1 in a range from 0.235 to 0.312 inches and the inner wall thickness T1 of the curved metal tube is in a range from 0.035 to 0.050 inches.

The design ratios and preferred outer tube diameter and inner wall thicknesses can be ascertained from the following data comparisons:

DATA COMPARISONS

| Steel Material | Cross-section Area | Relative Weight | Section Modulus | Relative Bend Strength |
|---|---|---|---|---|
| 0.235" dia. rod (conventional) | .0434 sq in | basis | .00111 in.$^4$ | basis |
| 0.250" dia. rod (conventional) | .0491 | +13% | .00153 | +38% |
| 0.275" OD × 0.050" wall tubing | .0353 | −18% | .00171 | +54% |
| 0.250" OD × 0.035" | .0136 | −46% | .00112 | +1% |

-continued

DATA COMPARISONS

| Steel Material | Cross-section Area | Relative Weight | Section Modulus | Relative Bend Strength |
|---|---|---|---|---|
| wall tubing 0.250" OD × 0.049" wall tubing | .0309 | −29% | .00133 | +20% |
| 0.312" OD × 0.035" wall tubing | .0305 | −25% | .00187 | +110% |

As noted above, metal other than steel can be used to achieve the purpose of this invention. However, steel offers the advantage of a combination of economy, weldability, and overall strength. Sizes of the tubing other than the preferred embodiment can be used to achieve the same purpose of this invention. The relative weight saving of metal can be estimated based on cross-sectional area of the metal. The relative strength against bending and relative stiffness can be estimated based on a calculated section modulus.

The tubular curved members 22 have a circular cross-section in the preferred embodiment. However, other cross-sectional shapes can be employed without deviating from the scope of the invention. For example, the cross-sections can be triangular or rectangular in shape. Other shapes include but are not limited to pentagonal, octagonal, hexagonal, etc. An oval/elliptical shape tubular curved member oriented with its major axis along the predominate axis of impact (outside-to-inside) would have greater strength than a similarly sized tubular curved member having a circular cross-section.

The method of making the tubular curved members 12 involves the step of providing at least one tubular curved member having a predetermined outer diameter and a predetermined wall thickness. The predetermined wall thickness and outer diameter of the tubular curved members 12 are determined by calculating three ratios: the first ratio relates the relative strength to weight of the tubular member; the second ratio relates a field of vision having the tubular member to strength of the at least one tubular member; and the third ratio relates a field of vision having the at least one tubular member to weight of the at least one tubular member.

The tubular curved member 12 is then made of at least one of a metal and metal mixture. The tubular member is then coated with a protective covering 18. Another step involves the extension of a plurality of tubular curved members in biaxial directions and crossing the plurality of tubular members relative to each other. The method further includes the steps of slightly indenting 16 each tubular member at locations where the plurality of tubular members 12 cross each other and at tapering ends 14 of each tubular member. Another step is connecting the tubular members by welding. Although the tubular members can be indented or tapered with a clamping device during or after the bending or curving step, the indenting of the tubular curved members occurs almost automatically during the welding step, wherein the clamping force and heat of welding generate the indentation or tapering of the tubular curved members. In resistance welding, a clamping force is required to establish electrical continuity and its magnitude can be controlled to produce the desired degree of indentation or taper of the tubular curved members. In hand welding, a clamping force from a fixture is desirable to hold the position of the tubular curved members.

The method further includes the steps of forming the plurality of tubular members 12 out of steel; forming outer diameters D1 of each tubular member in a range from 0.235 to 0.312 inches; and forming wall thicknesses T1 of each tubular member in a range from 0.035 to 0.050 inches. The method further includes the step of attaching the at least one tubular member to an enclosing headpiece 20.

With the tubular members described above, a face guard which is lighter, stronger, and stiffer and reduces head and neck fatigue of the user can be made. The tubular members promote quick response of the face guard user by permitting the user to move his/her head and body more rapidly. The tubular members reduce the force of impact on a person or object being hit by a user with the face guard comprised of the tubular members. The tubular members provide a stronger face guard structure that does not significantly reduce the field of vision of a user.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A face guard comprising:

a plurality of tubular curved members, each tubular curved member having a predetermined outer diameter and a predetermined wall thickness, said outer diameter and wall thickness being a function of at least three ratios, said tubular member being made of steel;

a coating for covering each tubular member, said tubular curved members extend in biaxial directions and cross each other, the tubular members are slightly indented at locations where the plurality of tubular members cross each other, ends of each tubular member of said plurality of tubular members are substantially tapered;

means for connecting at least two tubular members at said locations where the plurality of tubular members cross each other and at said ends of each tubular member, said means for connecting includes welds;

a first ratio of said at least three ratios being a relative strength to weight ratio, wherein strength of each tubular member being at least equal to a solid rod made of a same material of each tubular member and said rod having an outer diameter slightly less than each tubular member, while weight of each tubular member being substantially less than said solid rod, whereby frontal and side impact forces are absorbed by each tubular member without deformation;

a second ratio of said at least three ratios being a relative vision obstruction to strength ratio, wherein said face guard is adapted to be placed in a field of vision of a user, said field of vision having each tubular member is substantially similar to a field of vision having a solid rod with a same shape as each tubular member, while each tubular member has strength to absorb said frontal and side impact forces, whereby said vision of said user is substantially unobstructed; and a third ratio of said at least three ratios being a relative vision obstruction to weight ratio, wherein said face guard is adapted to be placed in a field of vision of a user, said field of vision having each tubular member is substantially similar to a field of vision having a solid rod with a same shape of each tubular member, while weight of each tubular member being substantially less than said solid rod, whereby said vision of said user is substantially unobstructed and wherein each tubular member protects said user from said frontal and side impact forces and reduces fatigue of said user, said outer diameter of each tubular member being determined by said ratios is in a range generally from 0.235 to 0.312 inches, and said wall thickness of each tubular member being determined by said ratios is in a range from generally 0.035 to 0.050 inches.

2. The face guard of claim 1, further comprising:

an enclosing headpiece, said plurality of tubular curved members having means for connecting said plurality of tubular curved members to said headpiece.

3. A method of making a face guard comprising the steps of:

providing a plurality of tubular curved members, each tubular curved member having a predetermined outer diameter and a predetermined wall thickness;

calculating a first ratio of said at least three ratios which relates the relative strength to weight of each tubular member, wherein strength of each tubular member being at least equal to a solid rod made of a same material of each tubular member and said rod having an outer diameter slightly less than each tubular member, while weight of each tubular member being substantially less than said solid rod, whereby frontal and side impact forces are absorbed by each tubular member without deformation;

calculating a second ratio of said at least three ratios which relates a field of vision having each tubular member to strength of each tubular member, wherein said face guard is adapted to be placed in a field of vision of a user, said field of vision having each tubular member is substantially similar to a field of vision having a solid rod with a same shape of each tubular member, while each tubular member has strength to absorb said frontal and side impact forces, whereby said vision of said user is substantially unobstructed;

calculating a third ratio of said at least three ratios which relates a field of vision having each tubular member to weight of each tubular member, wherein said face guard is adapted to be placed in a field of vision of a user, said field of vision having each tubular member is substantially similar to a field of vision having a solid rod with a same shape of each tubular member, while weight of each tubular member being substantially less than said solid rod, whereby said vision of said user is substantially unobstructed;

forming said plurality of tubular members out of a ferrous steel;

forming outer diameters of each tubular member in a range generally from 0.235 to 0.312 inches based on said ratios;

forming wall thicknesses of each tubular member in a range generally from 0.035 to 0.050 inches based on said ratios;

extending a plurality of tubular curved members in biaxial directions;

crossing said plurality of tubular members relative to each other;

slightly indenting each tubular member at locations where the plurality of tubular members cross each other;

tapering ends of each tubular member;

connecting said tubular members by welding; and coating each tubular member, wherein each tubular member protects said user from said frontal and side impact forces and reduces fatigue of said user.

4. The method of claim 3, further comprising the step of:

attaching said plurality of tubular member tubular members to an enclosing headpiece.

* * * * *